United States Patent [19]

Shaw

[11] 4,053,758

[45] Oct. 11, 1977

[54] UNDERWATER SWIMMING POOL ILLUMINATION SYSTEMS

[75] Inventor: Frank D. Shaw, Etobicoke, Canada

[73] Assignee: Swan Recreational Products Limited, Toronto, Canada

[21] Appl. No.: 671,353

[22] Filed: Mar. 29, 1976

Related U.S. Application Data

[63] Continuation of Ser. No. 477,003, June 6, 1974, Pat. No. 3,955,076.

[51] Int. Cl.[2] ..... F21V 31/00

[52] U.S. Cl. ..... 362/158

[58] Field of Search ..... 240/26, 10.5, 10.6 R, 240/10.6 CH, 41.55, 52.1, 73 QD, 52 R

[56] References Cited

U.S. PATENT DOCUMENTS

| | | | |
|---|---|---|---|
| 2,906,863 | 9/1959 | Ritter | 240/26 |
| 3,265,884 | 8/1966 | Kelley | 240/26 |
| 3,339,066 | 8/1967 | Hart | 240/26 |
| 3,793,516 | 2/1974 | Cassey | 240/26 |
| 3,801,022 | 4/1974 | Cassey | 240/26 |
| 3,852,587 | 12/1974 | Koehler | 240/26 X |
| 3,864,562 | 2/1975 | Hawkins | 240/26 |

FOREIGN PATENT DOCUMENTS

| | | | |
|---|---|---|---|
| 2,117,895 | 10/1972 | Germany | 240/26 |

*Primary Examiner*—Richard L. Moses
*Attorney, Agent, or Firm*—Donald E. Hewson

[57] ABSTRACT

An underwater swimming pool illumination system includes a lighting assembly having a lamp unit installed within its rear portion in a waterproof enclosure; and the lamp is connected to a low voltage battery. The waterproof enclosure may be at the bottom of a strut in an inverted L-shaped assembly, where the upper portion is a base which is fitted to a pad by a bayonet-type connection. The battery may be installed in the base, in which case the lighting assembly may be removed away from the pool to have the battery charged; or the battery may be remotely installed with a wire connection to the pad and lighting assembly. In either case, the installation is such that the lamp is completely electrically isolated from any alternating or ripple currents; either by physically removing the lamp from the pool for battery charging, or by a DPDT switch which either connects the battery to the lamp or to the charging circuit. This, in either case the battery is charged in a place remote from the swimming pool.

The waterproof lamp enclosure seals the rear portion of a seated beam lamp in a bowl-shaped body by an O-ring seal, when a retaining ring around the lamp is tightened against it. The retaining ring may be of a light diffracting material. The waterproof enclosure may also be attached to the wall of a swimming pool.

3 Claims, 9 Drawing Figures

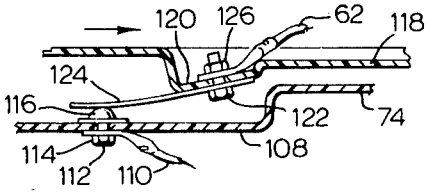
FIG. 4
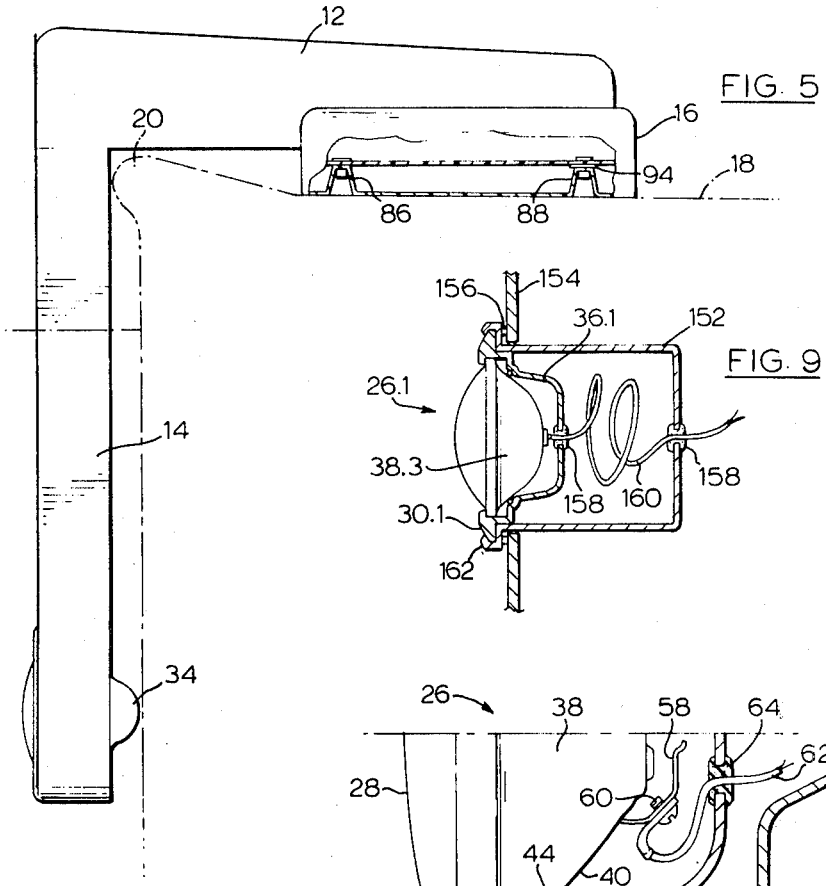
FIG. 5
FIG. 9
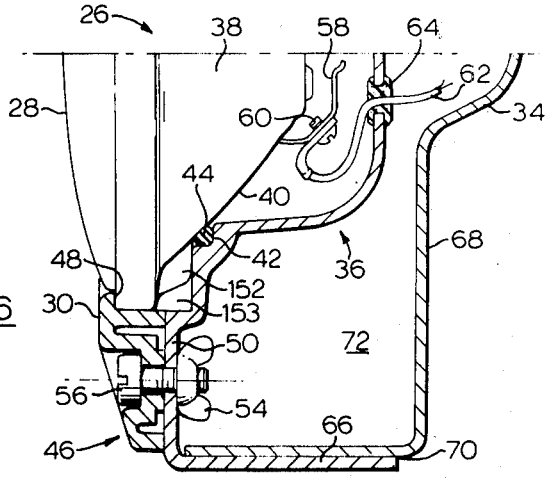
FIG. 6

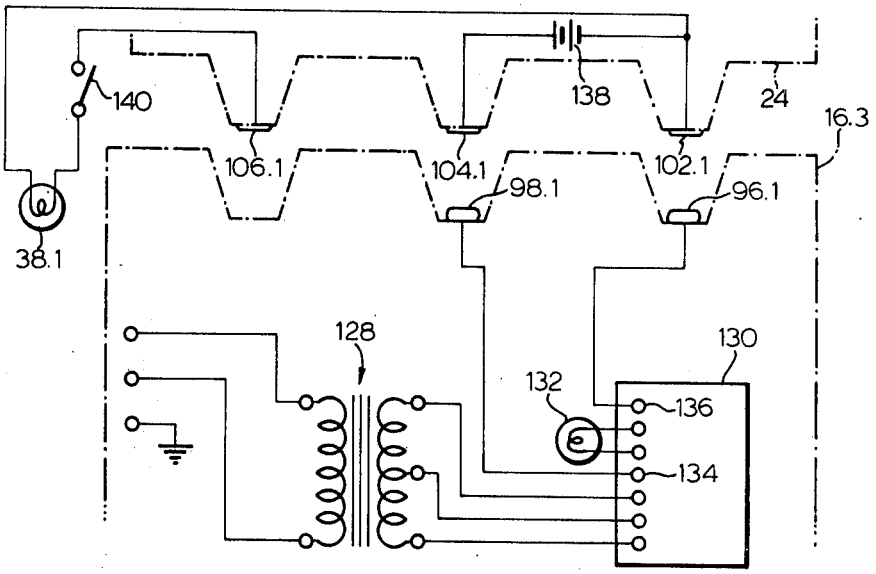
FIG. 7
FIG. 8
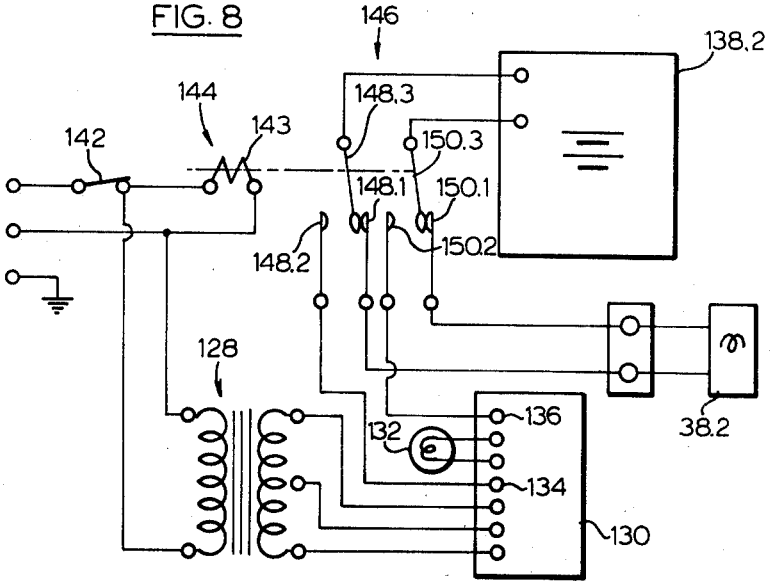

UNDERWATER SWIMMING POOL ILLUMINATION SYSTEMS

This is a continuation of application Ser. No. 477,003 filed June 6, 1974, now U.S. Pat. No. 3,955,076 dated May 4, 1976.

FIELD OF THE INVENTION

This invention relates to underwater swimming pool illumination systems; more particularly, this invention relates to an underwater lighting assembly for underwater swimming pool illumination systems. The invention is specifically directed towards underwater swimming pool illumination systems which may be portable, and which in any event can be installed at the time that a pool is being constructed or after the swimming pool has been constructed. Underwater lighting assemblies according to the present invention are particularly well adapted for use in private swimming pools.

BACKGROUND OF THE INVENTION

It is very often desirable to have underwater illumination in a swimming pool, for use at night, for special effects or simply for purposes of safety. This may be so even in commercial pools such as recreational pools which may be municipally or privately owned, pools in such establishments as health clubs and hotels, and pools which may be specially constructed for competitive purposes of swimming or diving. As well, many private owners of swimming pools desire to have underwater illumination in their pools. Normally, in the past, illumination in a swimming pool — whether it be private or commercial — has comprised a special lamp housing assembly which is fitted into the wall of the pool at the time that the pool is being constructed. Such lighting assemblies are intended to be operated from ordinary household power supplies — in North America, 108 to 120 volts at 60 hertz — and the lamp units are generally very high powered, incandescent lamps having power consumptions of from 350 to 750 watts. The light output from such units is of course very high; and most prior art swimming pool illumination systems have operated very hot. Thus, there is a slight danger of breakage if such a unit is turned on when the water in a swimming pool is extremely cold, and there is also a danger of a swimmer in the pool being burned by touching the unit. In addition, serious electrical hazards exist with the prior art underwater swimming pool illumination systems.

The most obvious electrical hazard which exists is of course, one of electrical shock. Stray currents may occur from any conventional underwater lighting assembly; and such stray currents may, of course, prove to be fatal if they are impressed on the body of a swimmer or even a person in the immediate area of a swimming pool. As a consequence, conventional underwater lighting assemblies which are installed in swimming pools require to be grounded, as well as all other metallic parts which may be installed in a pool such as ladders and the like; and also all metallic parts within ten feet of the surface of the water of the swimming pool are required to be grounded in most jurisdictions. Further, it is necessary for a ground fault detector to be installed, which shuts the system off in the event of any leakage current from either side of the two wire electrical supply to the conventional underwater swimming pool illumination assemblies, to ground. Of course, the effectiveness and safety of such equipment relies upon it being continuously inspected for consistency of operation.

Apart from the evident high costs of conventional underwater illumination lighting assemblies, yet another disadvantage exists, especially for owners of existing pools and persons who are installing new private pools which may be of the variety having steel walls and a vinyl liner. That is, in many smaller pools of the sort which are installed in private homes, the construction comprises a relatively thin sheet steel wall and a preformed vinyl liner installed within the pool. Because of their physical bulk, conventional underwater swimming pool lighting assemblies are difficult to install in vinyl-lined in-ground pools. As well, the cost of installing a conventional underwater lighting assembly in any swimming pool — whether it be vinyl lined, or with more conventional concrete walls — may be extremely high. This may be all the more difficult in circumstances where a deck or patio has been built around the periphery of the swimming pool, and where other matters of landscaping and decoration have been completed.

It has been noted, however, that it is possible to achieve a reasonable or satisfactory degree of illumination within a swimming pool with lighting assemblies having relatively low power consumption. That is, in a conventional private pool of, say, 16 feet by 32 feet or even 20 feet by 40 feet, and having a depth from 8 to 9.5 feet, low voltage lamp units having rated powers of from 25 to 35 watts, used either singly or in association with one or two other such units, provide quite adequate underwater illumination. Power for such lamp units may be derived from low voltage, direct current batteries of even modest ratings. In addition, it is possible to provide electrical connections to a low voltage battery — say, of 12 volt rating — in such a manner that the battery may be part of a self-contained lighting assembly, or be remotely mounted away from the immediate area of a swimming pool; and be connected in such a way that if the battery is electrically connected to a battery charging circuit, it is completely electrically isolated from the lamp unit of the lighting assembly so as to completely preclude alternating current hazards. It has been shown that stray alternating currents at even very low voltages may be fatal if the circumstances surrounding the manner in which they are induced upon a person's body are particularly unfortunate. Thus, for the sake of safety of any persons in or near a swimming pool having underwater illumination, and for relative ease of assembly and maintenance — not to mention economies both with respect to capital costs and operation — this invention provides that underwater lighting assemblies of the sort taught herein are powered by low voltage direct current batteries so as to provide a low voltage, ripple-free direct current power to the lamp unit of any lighting assembly according hereto.

In like manner, it has been determined that for purpose of decor, as well as ease and economy of production and of installation, an underwater lighting assembly according to this invention can be provided where such assembly is such that it may be easily lifted into and out of the water of a swimming pool. That is, at least the waterproof lamp enclosure of a lamp assembly of this invention may be such that it can be installed in, attached to or placed beside the wall of a swimming pool and easily removed therefrom. In the preferred embodiments of this invention as described herein, underwater lighting assemblies are provided wherein a base may be secured to a pad which is, in turn, secured to the deck of a swimming pool; and where a strut having a waterproof lamp enclosure in the lower portion thereof depends downwardly from one end of the base into the water of the swimming pool, so that the lamp unit in the lamp enclosure is below the surface of the water.

The waterproof lamp enclosure which is provided by this invention has a generally bowl-shaped body portion which is adapted to receive the rear portion of a conically shaped lamp unit — usually a sealed beam unit having a rating of from 25 to 35 watts. An O-ring seat is formed in the bowl-shaped body portion, and a compressible O-ring is fitted into the O-ring seat. A retainer is provided, together with suitable fastener means which are adapted to co-operate with a flange formed around the outer part of the bowl-shaped body portion, so that when the fastener means are tightened, the retainer means forces the conical-shaped rear portion of the lamp unit against the compressible O-ring. In the preferred embodiments, the retainer is a light diffracting lens ring which co-operates with the outer portion of the lamp unit.

Electrical wires which are attached to the lamp unit and which lead to a low voltage battery pass rearwardly from the body portion; and the rear of the body portion of the waterproof lamp enclosure is exteriorally waterproofed. This may be by use of a seal or a packing gland; and in the preferred embodiments, by sealing the strut in which the waterproof enclosure is formed so that interior of the strut is, itself, waterproofed. Also, the interior by the strut may be filled, at least in its lower portion with a foamable plastics material.

Because of its construction, a waterproof lamp enclosure according to this invention is essentially water-cooled when operating. All of the assembly in front of the O-ring is immersed in water, and the rear of the assembly is dry. In the preferred embodiments, the lamp assembly itself is immersed. In any event, it is possible to use plastics materials for all of the major structural components of a lighting assembly according to this invention without any risk of failure due to heat, and without electrical leakage.

The preferred embodiments of this invention provide two approaches to lighting assemblies for use in swimming pool underwater illumination systems, whereby the lighting assembly may either be self-powered — that is, having batteries enclosed within its structure — or where the lighting assembly may be remotely powered. Thus, with a minimum of additional requirement and a maximum interchangability of parts, self-powered or remotely powered lighting assemblies may be easily and economically produced and installed.

BRIEF SUMMARY OF THE INVENTION

It is therefore an object of this invention to provide underwater lighting assemblies for use in underwater swimming pool illumination systems having a unique waterproof lamp enclosure, and where the lighting assembly is electrically connected to a low-voltage battery.

A feature of this invention is that lighting assemblies according hereto may be either self-powered or remotely powered.

A further object of this invention is to provide a structure for lighting assemblies for use in underwater swimming pool illumination systems whereby the lighting assembly may be easily and quickly manufactured; and where such lighting assembly may be easily and inexpensively installed in a swimming pool.

Yet another feature of this invention is that lighting assemblies according hereto may be installed in existing swimming pools with a minimum of installation and capital costs and without the necessity for special protective and monitoring equipment.

BRIEF DESCRIPTION OF THE DRAWINGS

These and other features of this invention are more evident in the following discussion which is made in association with the accompanying drawings, in which:

FIG. 4 is a cross section of a typical electrical contact arrangement according to this invention;

FIG. 5 is a typical side view of the installation of a lighting assembly according to this invention in a swimming pool;

FIG. 6 is a partial cross section of a lamp unit installed in a waterproof lamp enclosure in a manner according to this invention;

FIG. 7 is a schematic and partially diagrammatic representation of the circuits according to one embodiment of this invention;

FIG. 8 is a schematic diagram of the electrical circuits according to another embodiment of the present invention; and FIG. 9, which is found with FIGS. 4 to 6, is a partial cross-section of an in-wall installation of a waterproof lamp enclosure according to this invention.

DESCRIPTION OF THE PREFERRED EMBODIMENTS

As noted above, this invention provides a waterproof lamp enclosure for use in underwater swimming pool illumination systems, and the waterproof lamp enclosure might be included in a lighting assembly which could be attached to the wall of a swimming pool, or it may be in a lighting assembly which can be placed in the pool and taken therefrom, at will. Of the latter sort of assembly, this invention contemplates that the underwater swimming pool illumination lighting assembly is one which may be fitted to a pad which is secured to the swimming pool deck. Also, as noted above, this invention contemplates that any underwater swimming pool illumination system in accordance hereto has electrical connections to the lamp from a battery so as to provide direct current power thereto; and is complete electrically isolated, in all instances, from any sort of alternating current.

Figure 1:
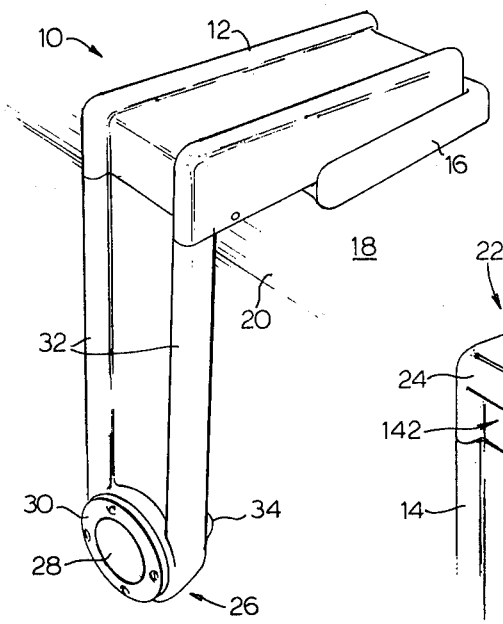
FIG. 1 is a perspective view of a first embodiment of an underwater lighting assembly of this invention.
Figure 2:
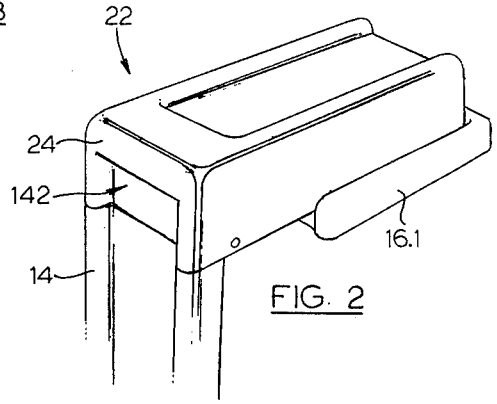
FIG. 2 is a partial perspective view of a second embodiment of an underwater lighting assembly according to this invention.

FIGS. 1 and 2 show slight differing physical embodiments of lighting assemblies in accordance with this invention which are fitted to a pad which, in turn, is secured to a swimming pool deck. Thus, in FIG. 1 there is shown a lighting assembly 10 for underwater swimming pool illumination which assembly comprises a base portion 12, a strut portion 14, and a pad 16. The pad 16 is secured to a swimming pool deck 18 having a coping 20, in a manner discussed hereafter. Likewise, the assembly 22 shown in FIG. 2 comprises a pad 16.1 and a base unit 24, together with strut 14. The pad 16.1 may be secured to the swimming deck or it may be secured in a place remote from the swimming pool deck and electrically associated with the charging apparatus, in a manner discussed hereafter. It will be noted, however, that one of the significant differences between lighting unit 10 and lighting unit 22 is that lighting unit 10 is remotely powered and is adapted to be more or less permanently positioned with respect to the swimming pool; whereas lighting unit 22 has its battery enclosed in the base unit 24 thereof, and must be removed from its pad which is secured to the swimming pool deck and carried to another, essentially identical pad, which may be secured to or in any event is electrically connected to a battery charger circuit.

Each of the lighting units 10 and 22 comprises a strut unit or member 14 which has a lamp enclosure 26 in the bottom portion thereof. The lamp enclosure has a lamp therein which may be a sealed beam unit having a front lens 28, and it is surrounded by a lens ring 30 which may function as a retaining means for the lamp, in a manner discussed hereafter.

Obviously, electrical wires to the lamp enclosure 26 must be provided, and they are installed within the interior of the strut 14 in each of the lighting units 10 and 22. The interior of each strut 14 may be essentially hollow and box-like because in general the strut is assembled from a front and back member which are each dimensioned so as to be fitted one to the other. In that manner, a substantially waterproof enclosure may be assembled. This is especially so when the structural components of the lighting assembly according to this invention including the struts, base and pads, are formed from a plastics material such as styrene or ABS. Such materials lend themselves to be easily and economically vacuum formed, and they are relatively light in weight. Also, of course, such plastics material as styrene or ABS can be available in a variety of colours; and, of course they are electrically non-conductive.

The struts 14 may be formed having a pair of ribs 32 at each side thereof, for purposes of stiffening and for purposes of appearance. Likewise, the strut 14 may have a bumper 34 formed in the rear thereof at the lower end thereof.

Turning now to FIG. 6, there is shown a waterproof lamp enclosure according to this invention. It should be noted that a waterproof lamp enclosure which is shown in FIG. 6 may be one which is at the bottom of a strut 14, or it may be a waterproof lamp enclosure of the sort which is adapted to be fitted or attached to the wall of a swimming pool — such as to more closely resemble a conventional underwater lighting installation.

The waterproof lamp enclosure 26 includes a generally bowl-shaped body portion 36 which is adapted to receive the rear portion of a lamp unit 38. Generally speaking, the lamp unit 38 is a sealed beam unit, and its rear portion, is, in any event, conically shaped, having a rear surface 40. An O-ring seat 42 is formed around the outer part of the bowl-shaped body portion 36, and a compressible O-ring 44 is fitted into the O-ring seat 42. Retainer means, generally indicated at 46, and which would normally comprise a lens ring 30, are adapted to fit over the outer part of the lamp unit 38. Normally, the lamp unit 38 would have a flange 48 formed around the lens 28 and the retainer means 46 would be adapted to fit over the flange 48. A flange 50 is formed at the outer part of the bowl-shaped body portion 36; and fastener means such as a wing nut 54 and bolt 56 co-operate with the flange 50 and a retainer ring 46 to secure the lamp unit 38. The wing nuts 54, or other suitable fastener retaining means, may be secured to the rear side of the flange 50 adhesively, or they may be formed thereon, and they may be locked in position in a manner discussed hereafter. Usually, an indexing lug 152 is provided on the lamp 38, so that the lamp can be positioned by mating the lug 152 to a recess 153 formed in the flange 50 for the purpose. Thus, given any design of front lens 28 for a lamp 38, maximum light dispersion may be assured.

It will be seen that, when the bowl-shaped body portion 36 is properly dimensioned with respect to the lamp unit 38 which is adapted to be fitted thereto, tightening of the bolts 56 or other fastener means will cause the rear surface 40 of the lamp unit 38 to be formed against the compressible O-ring 44. Thus, the interior of the bowl-shaped body portion 36 is maintained in a waterproof condition, in that entry of water into the interior of the body portion 36 is precluded from the front.

At the rear of the lamp unit 38, there is a pair of clips 58 having bolts 60 or other suitable means so that wire 62 may be attached to the clips 58 to provide electrical power to the lamp 38. The wires 62 — only one of which is shown in FIG. 6 — enter the bowl-shaped body portion 36 from the rear thereof, and they may be sealed by such as a grommet 64 so as to maintain the interior of the body portion 36 in waterproof condition. Obviously, all parts of the enclosure which are in front of O-ring 44 are surrounded by water, and the lamp 28 is therefore water-cooled. The heat which is dissipated rearwardly of the lamp 28 into the body portion 36 is not such as to cause heat failure or softening of the material which the body portion 36 is made from.

When the waterproof lamp enclosure illustrated in FIG. 6 is formed in the bottom portion of a strut 14, the front and back members 66 and 68 respectively of the strut are fitted together to form a substantially box-like interior. Back member 68 may be dimensioned so as to fit into the front member 66 for the sake of appearance, and it may be solvent welded thereto as at 70. In that manner, the interior of the strut 14 — between front member 66 and back member 68 — will be substantially waterproof. Also, the lower portion 72 of the box-like interior of the strut 14 may be filled with a foamed plastic material such as a self-foaming rigid urethane; and usually such foamed plastics material is placed in the bottom portion of the strut to the height above the waterproof lamp enclosure 26. In that manner, the wing nuts 54 or other threadable fastener retaining means which may be placed behind the flange 50 to receive bolts 56, are securely locked in place. Likewise, the lower portions of wires 62 are held in place, and any likelihood of damage of the waterproof lamp enclosure 26 is substantially precluded.

It should be noted that, if it is desired that the waterproof lamp enclosure 26 be fitted or attached to the wall of a swimming pool rather than be formed in the lower part of a strut which is more common in accordance with this invention, the flange 50 can be adapted to be fitted to the wall of a swimming pool; and the nuts 54 to receive the bolts 56 may be suitably secured to or behind the wall of the swimming pool. Such installations would normally be made at the time that the swimming pool is being built, whether it be a vinyl-lined swimming pool or a concrete swimming pool.

A more usual but alternative embodiment of an in-wall installation of underwater swimming pool lighting assembly according to this invention is shown in FIG. 9, where a waterproof lamp enclosure 26.1 having a similar fastening and waterproof sealing arrangement as discussed with reference to FIG. 6, above, is installed in a conventional bowl 152 which is secured to wall 154 of a swimming pool and sealed as at 156. A waterproof gland or grommet 158 is installed at the rear of the bowl 152, and another is installed in the rear of the bowl-shaped body portion 36.1 of the lamp enclosure 26.1. A conventional two wire, long and flexible pigtail 160 extends between the waterproof grommets 158. The lens ring 30.1 of the lamp enclosure 26.1 may have a quick disconnect, quarter-turn fitting into a retaining ring 162 at the outer periphery of bowl 152. When the lamp enclosure 26.1 is installed, the bowl 152 is water-filled so that the lamp enclosure 26.1 is entirely immersed in water, but with the interior of its bowl-shaped body portion 36.1 dry and water-proof. If the lamp 38.3 must be replaced, it is merely necessary to remove the lamp assembly 26.1 from the bowl 152 by disengaging the lens ring 30.1 from its retainer 162, and to bring the lamp assembly 26.1 to the deck of the pool for easy access to the lamp 38.3. The flexible pigtail 160 is long enough to permit the lamp assembly 26.1 to be lifted up out of the water.

As noted above, FIGS. 1 and 2 shown different embodiments 10 and 22 of a lighting assembly having a waterproof lamp enclosure 26, a strut 14, and a base 12 or 24; where the strut 14 and base 12 or base 24 form a generally L-shaped assembly. The lamp assemblies 10 or 22 are usually adapted to be lowered into a swimming pool over the edge thereof; and the bases 12 or 24 of the lamp assemblies 10 and 22 respectively are each adapted to be secured to the swimming pool deck 18. In a normal installation of a swimming pool lighting assembly 10 or 22 according to this invention, the assembly is installed at the swimming pool by being fitted to a pad 16 or 16.1 respectively, which is in turn, secured to the swimming pool deck 18. However, an underwater swimming pool illumination lighting assembly such as lighting assembly 10 of FIG. 1 might in some circumstances, be directly secured to the deck 18.

Figure 3:
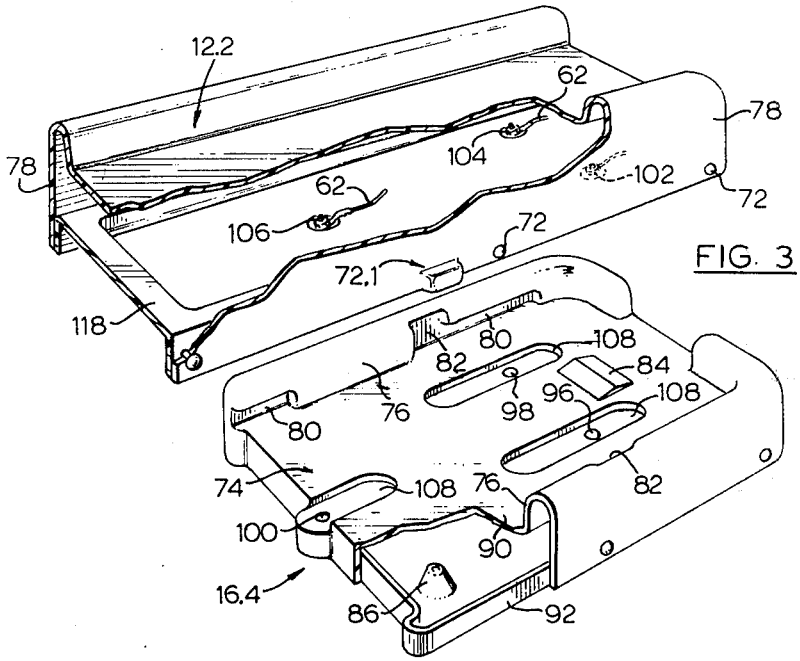
FIG. 3 is a partial, exploded and cutaway perspective view of a base portion and deck pad according to the present invention, showing the manner of their co-operation.

In any event, the lighting assembly 10 and the lighting assembly 22 may each be fitted to their respective pad 16 or 16.1 by being bolted thereto, or each may be fitted to its respective pad with a bayonet-like fitting relationship. Turning to FIG. 3 it will be noted that there is shown a portion of a base 12.2 — which might be the base portion of a lighting assembly 10 or a lighting assembly 22 — and there is shown a pad having a general designation 16.4. The principals of the mechanical and electrical assembly and connections with respect to the base 12.2 and the pad 16.4 apply to either of the lighting assemblies 10 or 22, with certain exceptions of detail as discussed hereafter.

The base 12.2 has a substantially rectangular plan when viewed from above. There are at least two spaced apart projections 72 from each side of the base 12.2; and the projections 72 may be the head of a fastening stud, or they may be formed into the side of the base such as shown at 72.1.

The pad 16.4 has a first, upper, surface 74 which is adapted to underlie a portion of the base 12.2 — as indicated in FIGS. 1 and 2, and also in FIG. 5 to be discussed hereafter — and there are upstanding sides 76 above the surface 74. The sides 76 are spaced from each other at a distance which is substantially the same as the distance between the sides 78 of the base 12.2. Each of the sides 76 of the base 16.4 has a pair of undercuts 80 formed therein, to accommodate a pair of the projections 72 from the side 78 of base 12.2. In the particular assembly illustrated in FIG. 3, a vertical keyway 82 is shown at the rear undercut, to accommodate the downward motion of the rearmost projection 72 on each side of the base 12.2.

It will be seen that the base 12.2 can be secured to the pad 16.4 by placing the base in a position forward of its final position so that the rear projection 72 can be accommodated for vertical movement downwards through keyways 82, and thereafter the base 12.2 can be slid rearwardly so that the projections 72 are accommodated in their respective undercut 80. An upstanding ridge or projection 84 may be formed in the upper surface 74 of pad 16.4 to wedge against the bottom of the base 12.2, and thereby to assure a more positive mechanical assembly of the base 12.2 to pad 16.4. Obviously, the interference between the projections 72 and the undercuts 80 is such as to preclude upward movement of the base 12.2 from pad 16.4.

Turning to FIG. 5, there is shown an assembly of a base 12 and strut 14 to a pad 16. Pad 16 is secured to swimming pool deck 18, having coping 20, by such means as a suitable epoxy or other cement or adhesive between the underside of the pad 16 and the swimming pool deck 18. Anchors may also be driven downwardly from the bottom of the pad 16 into the deck 18.

As shown in FIG. 3, a pad comprises an upper member 90 and a lower member 92. There may be formed in the lower member 92 a pair of front cones 86 and a pair of rear cones 88, which the underside of the top surface 74 of the upper member 90 of the pad butt against. As shown in FIG. 5, the cones 86 or 88 may have a spacer such as spacer 94 shown overlying a rear cone 88, so that the upper member 90 and the upper surface 74 thereof may be made level, no matter what the slope of the deck 18. In general, the deck 18 may have a gentle slope away from the coping 20 so that water splashed over the side of the swimming pool and past the coping 20 flows away from the pool. The bayonet-like assembly of the base to a pad which is secured to the swimming pool deck assists in overcoming or absorbing the force of a rocking motion which may be imposed upon the lighting assembly due to the wave action of water in the swimming pool.

As noted above, the lighting assembly may be remotely powered from a battery, or a battery may be included in the base of the lighting assembly. In either event, it is necessary that a positive electrical connection be made between the underside of the base and the upper side of the pad. Returning to FIG. 3, it will be noted that there are three electrical contact places on the surface 74 of the pad 16.4. They are designated 96, 98 and 100, respectively; and they are referred to in the following description as first, second and third electrical contact places of a pad, respectively. Likewise, there are three positions 102, 104 and 106 which are designated the first, second and third electrical contact places on the underside of the base 12.2. The respective electrical connections which may be made are discussed hereafter, in association with FIGS. 7 and 8. It should be noted, however, that when the base 12.2 is secured to the pad 16.4, a positive electrical connection is made at such of the first, second or third electrical contact places between the pad and the base as necessary and as discussed hereafter.

However for such positive electrical contact to be made, it is necessary that a mechanical assembly of electrically conductive elements be provided to assure that a good electrical contact is made so as to accommodate current flow from the battery to the lamp. Turning to FIG. 4, and with reference to FIG. 3, it will be seen that in the preferred embodiment, each electrical contact place in the surface 74 of the pad 16.4 is formed in a recess 108. An electrical wire 110 is suitably attached to a stud 112 which is electrically conductive, and the assembly may be tightened in place by nut 114. A contact member 116, being the head of the stud 112, thereby projects above the upper surface 74 of the pad 16.4 — although, in the preferred embodiments, a stud 116 is positioned within a recess 108 in the upper surface 74 for a purpose discussed hereafter.

The lower surface 118 of the base 12.2 has a downwardly extending wedge 120 formed therein, where the lower portion of wedge 120 is towards the front of the base — i.e., the lower portion of the wedge 120 is closest to the strut 14. An electrical wire 62 is secured to a stud 122; and on the underside of the wedge 120 there is secured an elongated metallic strip 124, with the entire assembly being fastened by such means as a nut 126. The metallic strip or leaf 124 is thereby mounted on the wedge 120 so as to be spring biased in a direction away from the underside of the lower surface 118 of the base; and it is placed on the underside of the base so as to make a wiping contact with the head 116 of stud 112 in the pad 16.4. Because the contact members 116 are located in recesses 108 in the pad 16.4, the leaf 124 may be secured onto the wedge 120 in such a manner that a good mechanical contact is assured between the leaf 124 and the contact 116, without mechanical interference otherwise of the metallic leaf 124 with the upper surface 74 of the pad 16.4 as the base 12.2 is assembled to the pad.

Turning now to FIG. 7, there is shown an electrical schematic diagram of an underwater wimming illumination system in accordance with this invention, where the battery is enclosed within the base of the lighting assembly. Such assembly is noted in FIG. 2, where the lighting assembly 22 has a base 24. The circuit of FIG. 7 includes a stepdown transformer 128 which is connected to a battery charging circuit 130, which includes suitable rectifiers, filters etc. for a battery to be charged. An indicator lamp 132 may be provided to indicate when the battery charging circuit is operating. Terminals 134, 136 of the battery charging circuit 130 are electrically connected to first and second terminals 96.1 and 98.1 of a first pad 16.3 which is remotely mounted away from the swimming pool. The base 24 has a battery 138 installed therein, and the battery is electrically connected to contacts 102.1 and 104.1 on the underside of the base 24. Thus, when the base 24 is assembled to the pad 16.3, and the battery charging circuit 130 is turned on, the battery 138 can be charged. The lamp 38.1 in the lighting assembly in FIG. 7 is also electrically connected to terminal 102.1 in base 24, but it is connected to terminal 106.1 in the base 24 so as to be remote from the battery 138. A switch 140 may be associated with the lamp 38.1 and may be mounted in the base 24. When the base 24 is assembled to a pad 16.1 which is secured to a swimming pool deck, and when the second and third contact members 98 and 100 of the pad 16.1 are internally connected together, it will be seen that a complete electrical circuit is provided so that power may be delivered from the battery 138 to the lamp 38.1 when switch 140 is closed.

For easy mounting of the base 24 of the lighting assembly 22 to a pad 16.1 or 16.3, fingerholds such as undercut 142 can be molded into the base 24. It is also seen that when the lighting assembly 72 is positioned on its pad 16.3, the battery 138 is connected to the battery charging circuit 130; and when the lighting assembly 22 is positioned on its pad 16.1, the battery 138 is connected to the lamp 16.1. In no event is the battery charging circuit 130 connected to the lamp 38.1; and thus there is no chance of any ripple current from the battery charging circuit 130 being imposed on any person in or near the swimming pool when the lamp 38.1 is in operation.

Turning now to FIG. 8, there is shown an electrical circuit of another embodiment of an underwater swimming pool illumination system according to this invention, where the lighting assembly is more or less permanently installed at a swimming pool. The lighting assembly 10 of FIG. 1 is particularly contemplated by the circuit of FIG. 8. In this circuit, transformer 128 and battery charging circuit 130, with indicating light 132, may be the same as in the circuit of FIG. 7. A switch 142 is provided which, when closed, connects a relay coil 144 across the primary of the transformer 128. The pole-piece 143 of the relay 144 is, in turn, mechanically connected to a double-pole, double-throw switch indicated generally at 146. The double-pole, double-throw (DPDT) switch 146 has a first pole 148 and a second pole 150, respectively; having first contact elements 148.1 and 150.1 and second contact elements 148.2 and 150.2 respectively, as well as first and second switch elements 148.3 and 150.3 respectively. The first and second switch elements 148.3 and 150.3 are ganged, and are connected to the pole-piece 143 of relay 144 in a manner so as that when the relay is now powered — i.e., switch 142 is open — the switch elements 148.3 and 150.3 are in their second pole position; and when switch 142 is closed so that relay 144 is powered, the switch elements 148.3 and 150.3 are in their first pole position.

The lamp 38.2 of a lighting assembly 10 is connected to two contact elements in the base 12; and the mating contact elements of the pad 16 are connected to the first contact elements 148.1 and 150.1 of DPDT switch 146. The second contact elements 148.2 and 150.2 of DPDT switch 146 are connected to output terminals 134 and 136 respectively of battery charging circuit 130. The switch elements 148.3 and 150.3 of the DPDT switch 146 are connected to the battery 138.2.

Thus, when the switch 142 is open, the battery charging circuit 130 is connected to the battery 138.2; and lamp 38.2 is completely electrically isolated from the battery charging circuit. Likewise, when the switch 142 is closed, the lamp 38.2 is powered from the battery 138.2, and the output of the battery charging circuit 130 is isolated. The battery 138.2 is, of course, remotely mounted away from the swimming pool. Suitable buried wire connections between the battery and the pad 16 can be made; and since the wires will only ever be connected to a low-voltage battery so as to only ever supply ripple-free direct current to the lamp 38.2, there is no necessity or requirement for special ground fault detectors, leakage current detectors, etc.

Obviously, in an underwater swimming pool illumination system installation using the circuit of FIG. 8, only two of the three contact places on each of the base and pad are used; but the ability ot use the same components in either type of installation provides very great economies. Further, the circuit of FIG. 8 is applicable to an installation of a lamp assembly 26.1 as shown in FIG. 9, except that there may be a solid connection between the battery and the lamp without an intervening pad contact.

In a typical underwater swimming pool illumination lighting system installation in accordance with this invention, a 35 watt lamp is used, and a 12 volt battery. Thus, the current handling requirements of the electrical wires and contacts in the installation do not exceed 3 amperes. A typical battery is a 12 volt gel-cell battery having an ampere-hour rating of about 18 to 20, thereby enabling the battery to be used in a portable lighting assembly for several nights of typical swimming pool use without having to be recharged.

The mechanical portions of lighting assemblies in accordance with this invention are, as noted, generally formed of a plastics material. Thus, the struts, bases and pads are usually vacuum formed from a sheet of plastics material such as ABS; the interior of the strut may be at least partially filled with self-foaming urethane; and the bowl-shaped body portion of the waterproof lamp enclosure as well as the lens or retaining ring may be injection molded LEXAN (T.M.) or other polycarbonate. When a material as polycarbonate is used for the lens ring, the ring has a different index of refraction than either glass — which is in the lamp lens 28 — or water, and thus the lens ring has light diffracting or diffusing properties.

The charging circuit 130 is provided to match the voltage and charging characteristics of the battery being used; and has therefore not been further discussed herein. Normally, such battery charging units are essentially "off-the-shelf" items, and would usually be provided with short circuit protection across their output.

Many other alterations or amendments to underwater swimming pool illumination systems in accordance with this invention, other than those discussed above, may be made without departing from the spirit and scope of the appended claims.

I claim:

1. For use in underwater swimming pool illumination, an underwater lighting assembly comprising:

a waterproof lamp enclosure having a generally bowl-shaped body portion adapted to receive the rear portion of a conically-shaped lamp unit, an O-ring seat formed around the outer part of said body portion and a compressible O-ring fitted in said O-ring seat, retainer means to fit over the outer part of said lamp unit, a flange formed around the outer part of said bowl-shaped body portion, and fastener means associated with said flange and said retainer means to cause the rear portion of said lamp unit to be forced against said compressible O-ring when said fastener means are tightened;

electrical wires attached to said lamp unit and passing rearwardly from said body portion, and means for exteriorally waterproofing the rear of said body portion;

and a low-voltage battery connected so as to provide low voltage, ripple-free direct current power to said lamp unit;

said low-voltage battery and a battery charging circuit being each remotely situated from said waterproof lamp enclosure, said battery being connected to the first and second switch elements of a double-pole, double-throw switch;

said electrical wires from said lamp being connected to first contact elements of the first and second poles of said double-pole, double-throw switch; and the output of said battery charging circuit being connected to second contact elements of the first and second poles of said double-pole, double-throw switch;

so that when said switch is in its first pole position, said battery is electrically connected to said lamp and not to said battery charging circuit;

and when said switch is in its second pole position, said battery is electrically connected to said battery charging circuit and not to said lamp.

2. The lighting assembly of claim 1 where said lamp unit is a low-voltage sealed beam lamp.

3. The lighting assembly of claim 1 where said retainer means is a light diffracting lens ring, of a material having an index of refraction different from that of glass or of water.

* * * * *